United States Patent [19]

Lewis et al.

[11] 4,177,713

[45] Dec. 11, 1979

[54] ELECTROHYDRAULIC PROPORTIONAL ACTUATOR APPARATUS

[75] Inventors: Leon D. Lewis, Palos Verdes; Wilfried Wiher, Redondo Beach; Warde L. Parker, Rancho Palos Verdes, all of Calif.

[73] Assignee: The Garrett Corporation, Los Angeles, Calif.

[21] Appl. No.: 816,774

[22] Filed: Jul. 18, 1977

Related U.S. Application Data

[62] Division of Ser. No. 576,611, May 12, 1975, Pat. No. 4,044,652.

[51] Int. Cl.[2] ..... F15B 9/10

[52] U.S. Cl. ..... 91/375 R; 91/376 A; 137/596.17; 137/625.24

[58] Field of Search ..... 91/387, 375 A, 375 R, 91/376 A; 137/625.24, 596.17

[56] References Cited

U.S. PATENT DOCUMENTS

| | | | |
|---|---|---|---|
| 2,613,649 | 10/1952 | Diebel | 091/375 R |
| 3,185,439 | 5/1965 | Inaba et al. | 91/375 R |
| 3,707,167 | 12/1972 | Colletti | 91/375 A |
| 3,750,532 | 8/1973 | Kubilos | 91/387 |
| 3,858,484 | 1/1975 | Saida | 91/376 A |

*Primary Examiner*—Paul E. Maslousky
*Attorney, Agent, or Firm*—Henry M. Bissell

[57] ABSTRACT

An electrohydraulic proportional actuator for converting an electrical input signal to proportional mechanical output. Fluid power may be derived from pressurized fuel or lubricating oil of an associated engine. The actuator may be used to drive any engine function requiring modulated control. The mechanical output is proportional to the electrical input. The actuator includes mechanical feedback to linearize the response function, thus eliminating the need for closed loop operation of the system in which the actuator is used. Both linear and rotary actuators are disclosed in various embodiments. Each type is capable of operation with either a proportional solenoid and valve or a force rebalance solenoid and valve.

30 Claims, 8 Drawing Figures

ELECTROHYDRAULIC PROPORTIONAL ACTUATOR APPARATUS

CROSS-REFERENCE TO RELATED APPLICATION

This application is a division of application Ser. No. 576,611, filed May 12, 1975, now U.S. Pat. No. 4,044,652.

BACKGROUND OF THE INVENTION

1. Field of the Invention

This invention relates to electrohydraulic actuator systems and, more particularly, to such systems for positioning the nozzle of an associated turbine.

2. Description of the Prior Art

The development of a satisfactory gas turbine engine for automotive vehicle power depends to a significant extent upon the effectiveness of its control systems. To compete successfully as an alternative to the already highly-developed piston engine as a vehicle power source, the gas turbine must not only be capable of comparable performance under all operating conditions, but preferably in a way and with a type of response which is familiar to the conditioned user of a piston engine-powered vehicle.

Most of the techniques required to satisfactorily control an automatic gas turbine are available from past experience with aircraft gas turbine engines. In a sense, the control system design may be more difficult because of the use by less sophisticated operators and the fact that it is practically necessary to cause the control system to simulate piston engine operation in the operator-machine interface. However, a more difficult problem is to realize the required control functions in devices which are acceptable on an economic basis for automotive utilization. Accordingly, many of the control devices and designs which are devised for use with gas turbine aircraft engines cannot be directly adapted to automotive use.

One of the particular control functions required for the automotive gas turbine engine is the positioning of the power turbine nozzles. Engine fuel flow and turbine nozzle position are controlled in response to various control and condition parameters such as accelerator pedal position, ambient temperature, ambient pressure, gas generator speed, gas generator turbine temperature, regenerator "hot side in" temperature, and transmission output shaft velocity. Because of the complexity of the control requirements, a computer is employed to operate with signals from a multiplicity of sensors and to develop the requisite control functions. Suitable actuators are required to operate in response to the computer control signals. Various types of electromechanical actuators are known, directed to a variety of output functions. Among these are the devices disclosed in the following U.S. Pat. Nos.: 2,055,209 of Schaer; 2,256,970 of Bryant; 2,570,624 of Wyckoff; 2,696,196 of Adams et al; 2,738,772 of Richter; 2,886,010 of Hayos et al; 3,264,947 of Bidlack; and 3,380,394 of Fornerod. Such prior art is exemplary of the technology to which the present invention relates.

SUMMARY OF THE INVENTION

In brief, arrangements in accordance with the present invention comprise a servoactuator which is particularly adapted to position the turbine nozzles of a vehicle power turbine in response to electrical command signals. In the vehicular system for which the present invention is developed, the electrical signals are produced by a control computer operating in accordance with the characteristics of the system and in response to condition signals provided by various sensors. The design of the computer is no part of the present invention. The servoactuators of this invention may be used in other systems and operated in response to signals derived from other sources. The servoactuators of the present invention produce an output motion in proportion to the input electrical control signals. In the particular vehicular turbine system with which these servoactuators are presently employed, the output movement of the servoactuator acts through a suitable linkage mechanism to drive a ring gear which in turn rotates the power turbine nozzles through the desired angular travel. In this system, nozzle position is modulated between 0° and 20° as a function of regenerator or gas generator inlet temperature during steady-state operation. Particular angular settings of the nozzles are specified during acceleration, deceleration and startup, in which case the idle and steady-state conditions are overridden. In addition, the actuators may be used to reverse the nozzles by positioning them in a braking mode so that some braking of the vehicle is actually attained from the turbine.

In one particular arrangement in accordance with the present invention, the servoactuator comprises a hydraulic motor having an output shaft for coupling to the ring gear which is connected to position the turbine nozzles. Movement of the hydraulic motor is controlled by a hydraulic servo valve which is actuated by a proportional solenoid. A lever is pivotably anchored at one end and is pivotably connected to the protruding rod of the hydraulic motor at the other end. A second rod, which protrudes from the proportional solenoid coil portion, is pivotably mounted intermediate the ends of the lever such that the motion of the hydraulic motor piston causes a translation of the solenoid and valve, thereby providing a follow-up mechanism for the servoactuator which serves to linearize the response of the servoactuator.

In accordance with particular aspects of the present invention, the servoactuator comprises a main body housing a hydraulic four-way valve, a transducer, and a piston so arranged as to provide linear movement of an output shaft attached to the piston which is proportional to an electrical input signal. The output shaft is arranged for coupling to a load which, in the vehicular turbine system described, is a ring gear coupled to rotate the turbine nozzles through the desired angular travel. The servo valve comprises a proportional solenoid-type, linear motion transducer and a high-gain, four-way hydraulic valve. The solenoid plunger has a conically-shaped face in order to minimize the range of operating force with travel. A hole through the plunger may be provided to control damping and thereby stabilize the valve spool. The plunger is spring-loaded and develops a travel which is proportional to input current to the solenoid coil.

In another arrangement in accordance with the present invention, a rotary actuator is employed, coupled to be driven by a rotary solenoid. The rotary actuator has a rotational output shaft for providing rotary output motion which is linearly proportional to an electrical input signal to the rotary solenoid. The position of the actuator is controlled by a rotary valve, the shaft of which is coupled to the rotary actuator by a follow-up spring. The rotary valve shaft is connected to the rotary solenoid shaft by a load spring such that when the actuator is in the "null" position, the load spring and follow-up spring are balanced in tension against each other.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENTS

Figure 1:
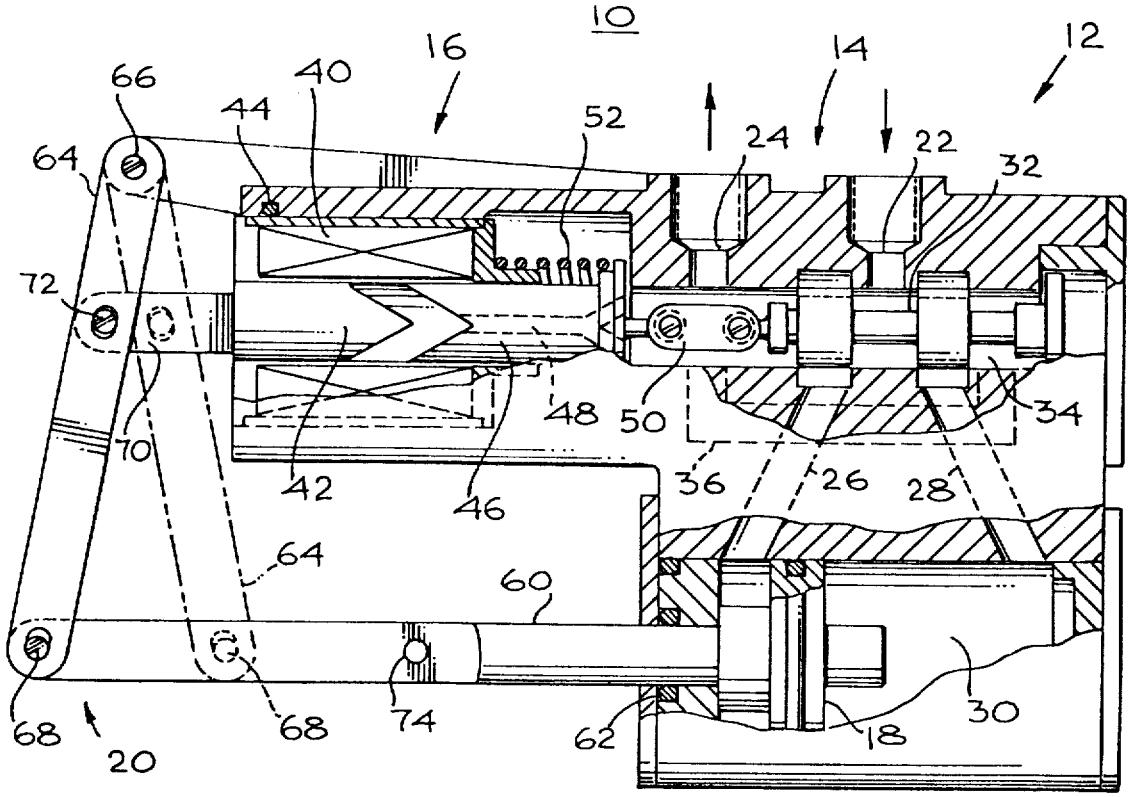
FIG. 1 is a front elevational view, partially broken away, of one particular arrangement in accordance with the present invention.

Referring to FIG. 1, a particular linear servoactuator 10 in accordance with the invention is shown comprising a main body or housing 12 which houses a four-way hydraulic valve 14, a proportional solenoid 16 and a piston 18. A follow-up linkage 20 connects the proportional solenoid 16 and piston 18, thus providing an output which is linearly proportional to the electrical signal input to the solenoid.

The hydraulic valve 14 has an inlet line 22 for connection to a supply of pressurized fluid (not shown) and an outlet 24 for connection to a fluid return line. Internal fluid lines 26 and 28 connect from the valve 14 to opposite sides of the piston 18 within its cylinder 30. A spool 32 is mounted to move laterally within the valve chamber 34 to admit pressurized fluid from the inlet 22 to a selected one of the internal lines 26, 28. Another internal line 36 connects the portion of the chamber 34 on the right-hand side of the spool 32 with the portion of the chamber on the left-hand side of the spool 32 to which the outlet 34 is connected.

The solenoid 16 comprises a coil 40 attached to a core 42 which is movable within the housing 12 in sealing relationship provided by a seal 44. The solenoid 16 has a plunger 46 shown with a central port 48. The plunger 46 is connected to the spool 32 by means of a link 50. The proportional solenoid is loaded by a compression spring 52 extending between adjacent faces of the coil 40 and the plunger 46 to provide a feedback force. The direct connection between the solenoid plunger 46 and the valve spool 32 via the link 50 provides zero backlash and simultaneously accommodates the close clearance of the spool valve. The plunger 46 operates in the fluid return passage of the servoactuator body, thus providing minimum operating force for plunger 46 and the valve spool 32. The hydraulic seal 44 for the solenoid is at the outer diameter of the coil 40, and the force for follow-up motion is provided by the piston 18. Since the valve 14 has a high-pressure gain, the error introduced to overcome seal friction is very small.

Coupled to the piston 18 is an output shaft 60 which is sealed within the housing 12 against leakage by means of the seal 62. The follow-up linkage 20 comprises a lever 64 which is pivotably anchored to the housing 12 at a pivot point 66 and is also pivotably connected to the shaft 60 at pivot point 68 and to a shaft extension 70 of the solenoid core 42 at pivot point 72. Coupling to the shaft 60 to drive the associated turbine nozzle ring gear (not shown) may be afforded via a coupling point 74. The phantom outline of the lever 64 shows the position of the linkage 20 corresponding to the movement of the piston 18 to the extreme right-hand position within the cylinder 30.

In the operation of the arrangement of FIG. 1, the system begins in a stable condition with the spool 32 closing off the fluid lines 26, 28 for a given level of input signal to the solenoid 16. As signal current is increased, a point is reached where the preload of the spring 52 is overcome by the electromagnetic force on solenoid plunger 46. This moves the servovalve spool 32 to the left, causing hydraulic fluid to flow from the pressurized fluid inlet 22 into the line 26 extending to the output shaft side of the piston 18. The piston 18 responds by moving to the right in the cylinder 30, thereby, by virtue of the linkage 20, also moving the solenoid core 42 and coil 40 toward the right. This causes the servovalve spool 32 to return to the null position, thereby closing off the lines 26, 28 and stopping the piston 18 at the new position. Further increase in signal current will cause the piston 18 to continue to the right by an amount proportional to the increase in signal current. Reduction in signal current causes the piston 18 to move to the left in similar manner.

In one particular embodiment of the invention corresponding to FIG. 1, the piston 18 is provided with a stroke of 2.50 inches and provides a force of 100 lbs. maximum with 100 psi supply pressure. Under maximum slew rate of 2.5 inches in 0.10 seconds, the actuator 10 provides a 15 lb. output force. Full actuator travel of 2.50 in. is equivalent to 90° total nozzle blade angle change. A piston diameter of 1.32 in. serves to meet the design maximum of 100 lb. output force. The solenoid plunger 46 has a travel of 0.50 in. in which its motion is proportional to input current to the coil 40. The four-way valve 14 develops the maximum slew rate with a travel of 0.04 in. of the spool 32. A selected size of the plunger port 48 serves to provide effective damping of the internal control system of the servoactuator.

Figure 2:
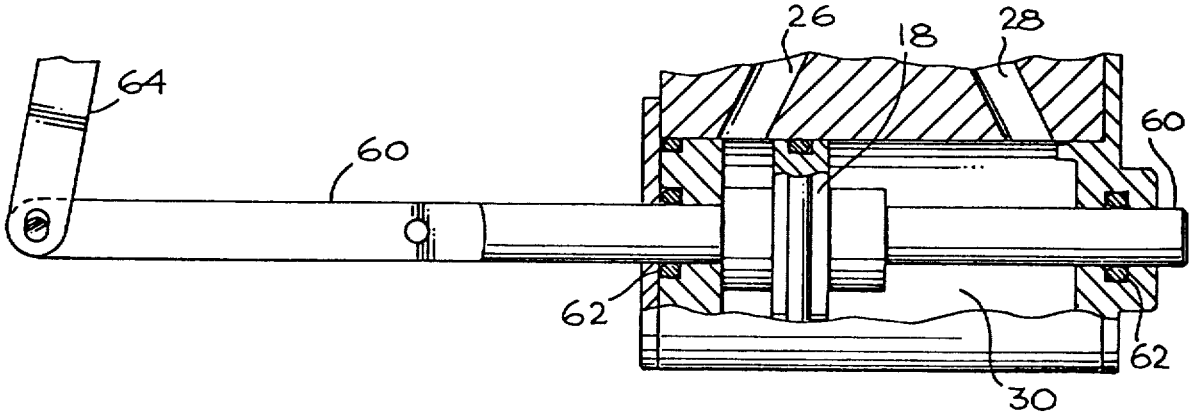
FIG. 2 is a similar view of a portion of the device of FIG. 1, showing a particular modification thereof.

FIG. 2 shows the cylinder portion of the arrangement of FIG. 1 with a minor modification in which the output shaft 60 extends out both ends of the cylinder 30 so that the drive coupling to the associated turbine nozzle ring gear may be effected at the right-hand end of the cylinder 30. In all other respects, the operation of a servoactuator corresponding to FIG. 2 would be the same as indicated for the actuator of FIG. 1.

Figure 3:
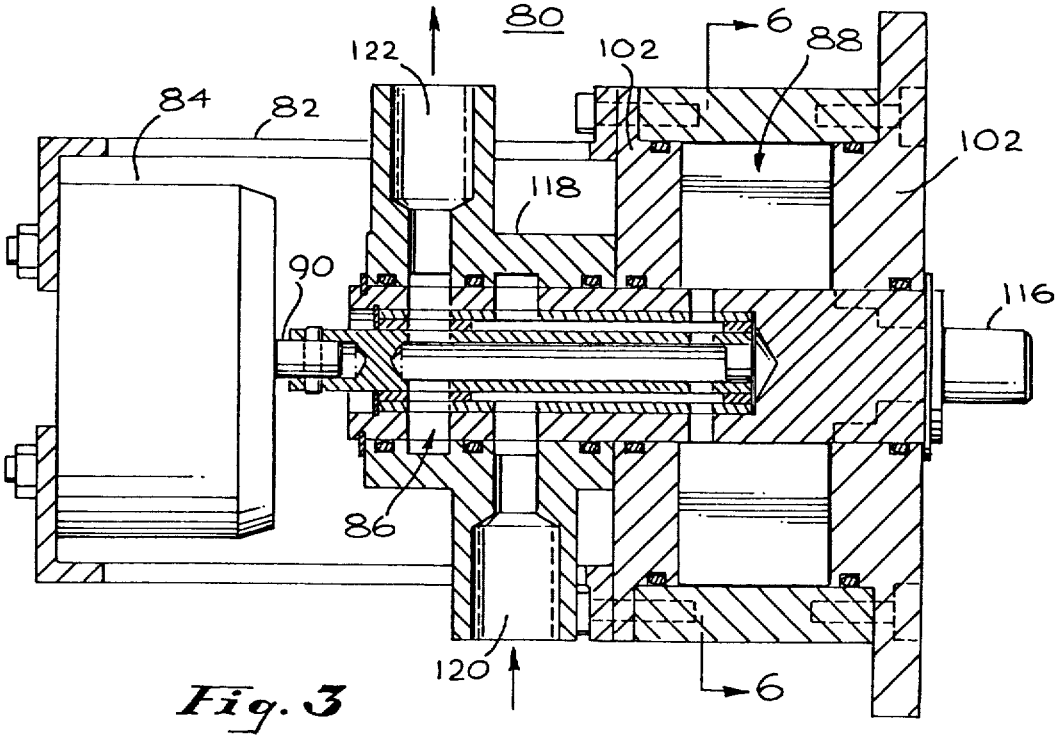
FIG. 3 is a similar view in longitudinal cross-section of another particular arrangement in accordance with the present invention.
Figure 4:
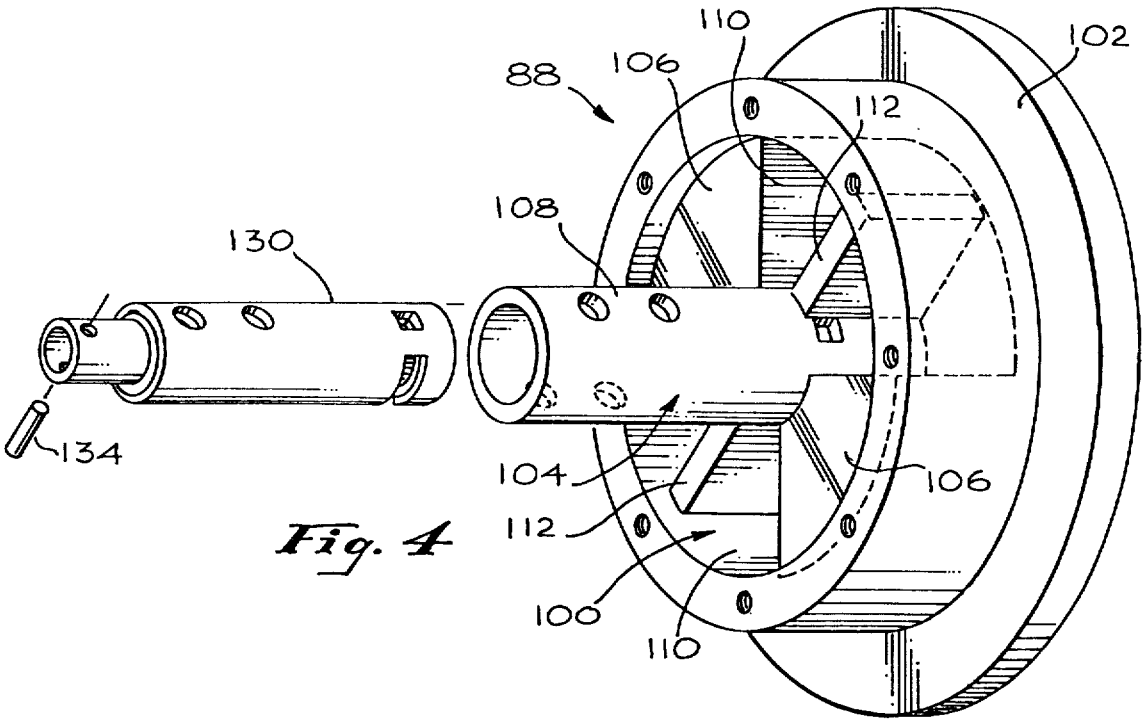
FIG. 4 is a partially-exploded view, in perspective, of a portion of the arrangement of FIG. 3.
Figure 5:
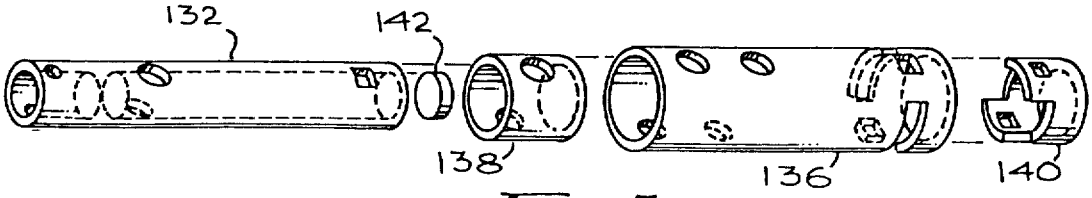
FIG. 5 is an exploded view of a portion of FIG. 4.

The embodiment of the invention represented in FIGS. 3, 4 and 5 comprises a rotary actuator 80 of the proportional solenoid type. As indicated in FIG. 3, the actuator 80 comprises a housing 82 containing a rotary solenoid 84, a valve assembly 86 and a drive assembly 88. The rotary solenoid 84 is of a type known in the art and may be purchased from Ledex, Inc., 123 Webster Street, Dayton, Ohio. It acts to provide a direct rotation of its output shaft 90 in response to electrical input signals.

The drive assembly 88 is shown more clearly in FIG. 4 as comprising a cylinder 100 between end plates 102 (see FIG. 3) that guide a dual-vane rotor 104 designed to travel through an angle of 90°. Two abutments 106, diametrally opposite from each other, are permanently attached to the inner walls of the cylinder 100 and form a close fit to the shaft 108 of the rotor 104. The abutments 106 serve as stops for angular travel of the rotor 104 and form two separate chambers 110 within which the two vanes 112 of the rotor 104 travel. The rotor output shaft 116 extends through the right-hand plate 102, which also serves as a mounting plate for the unit 80. The rotary shaft 108 also extends to the left-hand plate 102 and through a swivel manifold 118 (FIG. 3) that directs fluid into and out of the cylinder 100. Inlet 120 and outlet 122 conduct fluid between the swivel manifold and a source of pressurized fluid. The swivel manifold 118 remains fixed with respect to the housing 82 and allows the free flow of fluid during the full angular travel of the rotor 104.

The servovalve assembly 86 comprises a servovalve spool 130 (see FIGS. 4 and 5) having an inner shaft 132 drilled at the right-hand end for the hydraulic fluid return passage and at the left-hand end for coupling to the solenoid shaft 90 by means of a pin 134. The servovalve spool 130 also includes an outer sleeve 136, tubular spacers 138 and 140 for manifolding of the hydraulic fluid, and a plug 142 for mounting in the hollow section of the inner shaft 132. The supply passage of the servovalve spool 130 is between the inner diameter of the outer sleeve 136 and the outer diameter of the inner shaft 132.

Figure 6:
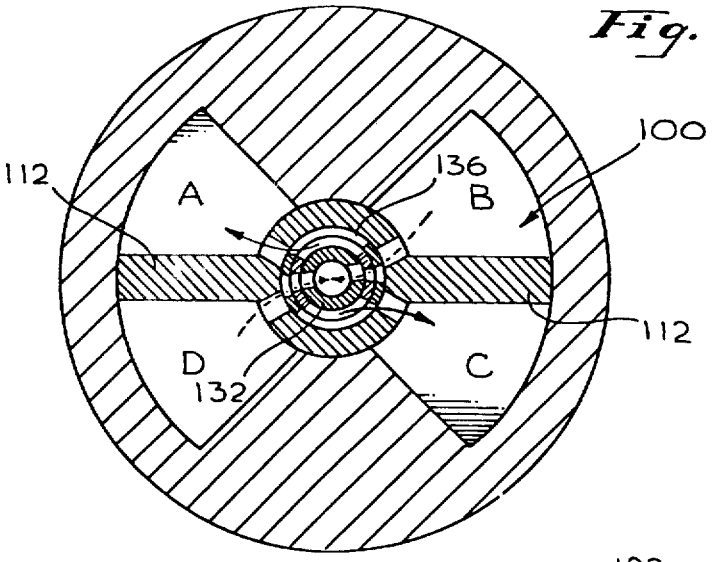
FIG. 6 is a schematic representation illustrating the fluid flow in the device of FIGS. 3 and 4.

The operation of the rotary actuator of FIGS. 3–5 may be better understood by reference to FIG. 6, which is a cross-sectional view taken along the line 6—6 of FIG. 3, looking in the direction of the arrows. When the servoactuator 80 is in the static mode, pressure is equalized in the chambers A, B, C and D of the cylinder 100. However, when the servovalve assembly 86 is positioned as shown in FIG. 6 to develop the actuator in the pressurized mode, pressure is directed to the chambers A and C from the spaces between the sleeve 136 and the shaft 132. At the same time, porting is arranged to permit the connection of the chambers B and D to the return via the hollow section of the shaft 132. As a result of the pressure differential across the rotor vanes 112 (supply pressure in chambers A and C, zero pressure in chambers B and D), the vanes 112 cause a counter-clockwise rotational movement which is coupled to the output shaft 116. Movement of the rotor 108 in this fashion brings the spool assembly 86 to a position where the fluid ports are again closed, thus maintaining the position of the rotors 112 and output shaft 116 as determined by the solenoid shaft 90 in response to a given electrical signal current level in the solenoid 84. Increased solenoid current causes a further rotation of the solenoid shaft 90, a corresponding rotation of the valve spool assembly 86, again creating a differential pressure condition across the vanes 112 in the cylinder 100, thereby developing further rotation of the vanes 112 and the output shaft 116 to the new position determined by the level of current in the solenoid 84. Reduction of current level in the solenoid 84 causes a differential pressure across the vanes 112 in the opposite direction and a resulting rotation of the vanes 112 and output shaft 116 in the clockwise direction of FIG. 6.

Close working clearances are provided between the ends of the vanes 112 and the inner cylinder walls, between the left and right-hand sides of the vanes and the cylinder side plates, and between the inner diameter of the abutments 106 and the rotor shaft 108 to minimize leakage through these clearances during operation. Proper fit between the ends of the vanes 112 and the inner wall of the cylinder 100 requires close control of concentricity of all mating parts. Spring-loaded slippers can be provided on the ends of the vanes 112 to minimize leakage with relaxed machine tolerances if desired. Clearances between the left and right-hand edges of the vanes 112 may be controlled by shimming adjacent the flanges of the cylinder end plates 102.

Figure 7:
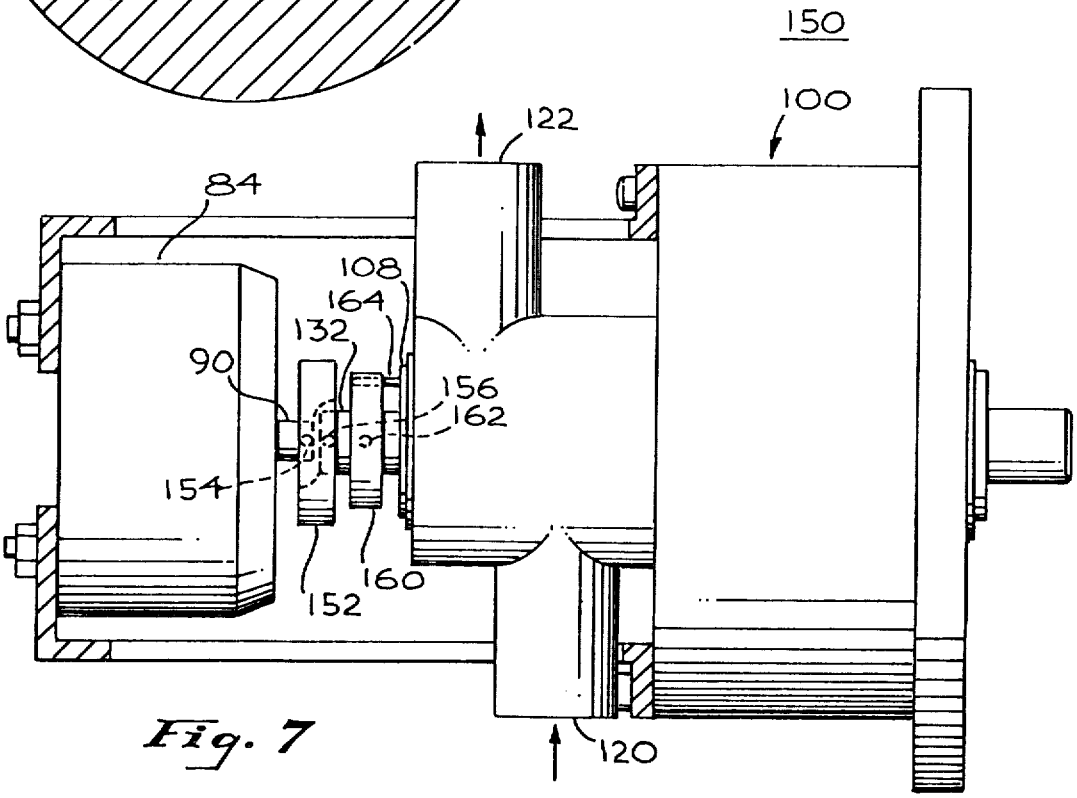
FIG. 7 is a front elevational view of still another arrangement in accordance with the invention.
Figure 8:
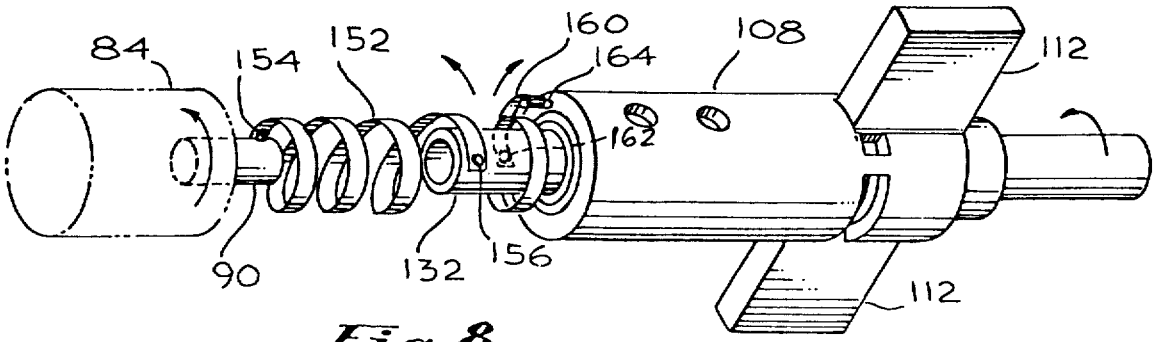
FIG. 8 is an exploded view of the spring feed back system arrangement of FIG. 7.

FIG. 7 and 8 illustrate a rotary actuator in accordance with the invention which is essentially the same as that shown and described in connection with FIGS. 3–6, except that a torsion load spring is interposed as the connection between the rotary solenoid shaft 90 and the shaft 132 of the rotary valve assembly 86. Also, a follow-up spring is inserted to provide a connection between the rotary valve assembly 86 and the vane rotor shaft 108. The resulting rotary actuator 150 of FIG. 7 provides a force balance system in which the load spring 152, connected to the solenoid shaft 90 by pin 154 and to the valve shaft 132 by pin 156, and the follow-up spring 160, connected to the shaft 132 by a pin 162 and to the vane rotor 108 by pin 164, are balanced in tension against each other in the null position. Angular travel of the rotor 108 proportional to current input to the solenoid 84 is attained by proper matching of the solenoid characteristics and the rate of the load spring 152.

By virtue of the particular arrangements in accordance with the present invention as shown in the accompanying drawings and described hereinabove, improved proportional response operation is afforded in both the linear and rotary actuators of the present design. These actuators are particularly designed for and may be used to advantage in the turbine nozzle positioning systems for an improved and simplified automotive vehicle turbine propulsion system. The inherent linearization of these actuators enables the turbine nozzle control system to be operated without the need for the provision of closed loop control, thus substantially reducing the cost and complexity of the turbine control system so that turbine propulsion becomes a more viable alternative to the conventional piston engine for automotive vehicle propulsion.

Although there have been described above specific arrangements of electrohydraulic actuators in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Electrohydraulic proportional actuator apparatus comprising:

a rotary valve and rotary hydraulic actuator mounted and interconnected within a housing, the valve having a torque signal input shaft including a hollow portion defining a longitudinally extending first fluid passage and a sleeve member surrounding the shaft hollow portion and spaced from the shaft outer surface by spacing means to define a longitudinally extending, circumferential second fluid passage, the actuator having an output shaft coupled to a motive member, the spacing means comprising a pair of tubular spacers at opposite ends of the second fluid passage;

means for coupling the valve to a supply of pressurized fluid, the valve being movable relative to the motive member between a null position and respective flow positions for applying pressurized fluid via one of said first and second passages selectively to one side or the other of the motive member;

a transducer coupled to drive the valve to a selected flow position corresponding to an electrical signal applied to the transducer; and means response to the movement of the motive member for restoring the valve to its null position upon the motive member reaching a position corresponding to the electrical signal applied to the transducer.

2. Apparatus in accordance with claim 1 wherein the motive member comprises a vaned rotor mounted for rotary movement within a cyinder in the housing and having an internal rotor shaft coupled to the rotor.

3. Apparatus in accordance with claim 2 wherein said rotary valve and said rotor shaft each have a plurality of ports alignable with each other for controlling the flow of fluid through said cylinder.

4. Apparatus in accordance with claim 3 wherein said rotor shaft has a longitudinal central bore and the rotary valve sleeve member is mounted within said bore and is selectively ported to provide fluid communication with the ports of the rotor shaft.

5. Apparatus in accordance with claim 4 wherein the rotary valve further comprises first and second tubular spacers mounted respectively at opposite ends of the sleeve member within the bore thereof for spacing the valve input shaft from the sleeve member and defining a manifold for hydraulic fluid in the second passage surrounding the valve input shaft.

6. Apparatus in accordance with claim 5 further comprising a plug for mounting in the central bore of the valve input shaft for closing the central bore thereof except for the ports in the input shaft.

7. Apparatus in accordance with claim 1 wherein the housing includes respective pressure fluid and return fluid portions in communication with said valve.

8. Apparatus in accordance with claim 2 wherein said rotor includes a pair of diametrally opposed vanes and wherein said cylinder includes a pair of diametrally opposed abutment members, the abutment members defining opposed cylinder segments containing the vanes, the vanes and abutment members being arranged to provide balanced movement of the rotor through an angle of approximately 90°.

9. Apparatus in accordance with claim 8 wherein each rotor vane divides its associated cylinder segment into a pair of fluid sections and wherein the rotary valve, when in the flow position, is adapted to direct pressurized fluid to diametrally opposed sections and to transfer return fluid from other diametrally opposed sections.

10. Apparatus in accordance with claim 1 wherein the transducer comprises a solenoid and the electrical signal is a current level in the solenoid.

11. Apparatus in accordance with claim 10 wherein the solenoid comprises a rotary solenoid having an output shaft rotatable through an angle which is proportional to an applied current level, and means for coupling the solenoid shaft to the valve input shaft.

12. Apparatus in accordance with claim 11 wherein the means coupling the solenoid shaft to the valve input shaft includes a pair of torsional springs balanced in tension against each other.

13. Apparatus in accordance with claim 12 wherein the pair of torsional springs comprises a first torsional spring extending between the solenoid shaft and the valve input shaft, and a second torsional spring extending between the valve input shaft and the rotor shaft.

14. Apparatus in accordance with claim 12 wherein said springs comprise a load spring connected between the solenoid shaft and the inner shaft of the rotary valve and a follow-up spring connected between the inner shaft of the rotary valve and the rotor shaft, said springs being balanced in tension when the valve is in the null position.

15. A rotary actuator comprising:

a unitary housing;

a variable control member having a rotary output which is proportionally responsive to an applied control function;

a vaned rotor mounted for rotary movement within a pressure chamber of said housing and having a rotary output shaft coupled thereto; and a rotary valve means mounted with the rotor within said housing and coupled between the control member and the rotor for controlling the application of pressurized fluid to the pressure chamber in accordance with the position of the rotor relative to the position of the control member rotary output, the valve means having a first element coupled for movement with said control member rotary output and a second element integral with said rotor, the rotary valve first element comprising an input shaft having a hollow portion defining a longitudinally extending first fluid passage and an outer sleeve surrounding the input shaft and spaced therefrom by opposed tubular spacers to define a longitudinally extending circumferential second fluid passage, the input shaft and the sleeve each having a plurality of ports for controlling the flow of fluid through the valve in accordance with the rotary position of the input shaft and sleeve relative to the second element.

16. Apparatus in accordance with claim 15 wherein said outer sleeve is mounted on the input shaft for rotation therewith, the ports of the outer sleeve being respectively aligned with corresponding ports of the input shaft.

17. An actuator as claimed in claim 15 further including a torsion spring coupling the first element to the control member rotary output and a follow-up spring coupling between said first and second elements in balanced opposition to the torsion spring.

18. A rotary hydraulic valve for proportional control of an associated actuator in response to a variable control signal comprising:

an inner shaft coupled for rotation in accordance with the control signal, the shaft having a hollow portion defining a longitudinally extending first fluid passage;

an outer sleeve surrounding the shaft along at least the hollow portion and spaced therefrom to define a longitudinally extending, circumferential second fluid passage;

a pair of spacing members positioned at opposite ends of the second fluid passage and mounting the shaft relative to the sleeve, the spacing members being ported to complete a fluid path through the valve; and means responsive to movement of the actuator to a position corresponding to an applied control signal for blocking said fluid path.

19. The valve of claim 18 further including a housing encompassing the sleeve and shaft and defining circumferential fluid passages communicating respectively with the first and second passages.

20. The valve of claim 19 further comprising means for directing hydraulic fluid to and from the respective circumferential fluid passages of said housing.

21. The valve of claim 18 wherein the movement responsive means includes at least a pair of fluid passages for transmitting fluid between the valve and the actuator and means for varying the openings of said last-mentioned fluid passages in accordance with the extent of angular displacement of the actuator relative to the shaft and sleeve.

22. The valve of claim 18 in combination with a rotary solenoid coupled to drive the inner shaft in response to an applied electrical control signal.

23. The valve of claim 19 wherein each of the shaft, sleeve and a first one of the spacing members is ported with the ports thereof being aligned to provide communication for the flow of fluid between the first fluid passage and the circumferential fluid passage in the housing which communicates therewith.

24. The valve of claim 23 wherein the sleeve is further ported to provide communication for the flow of hydraulic fluid between the second passage and the circumferential fluid passage in the housing which communicates therewith.

25. The valve of claim of 18 wherein each of the inner shaft, outer sleeve and a second one of the spacing members is ported with the ports thereof in alignment to provide communication for the flow of fluid between said first fluid passage within the inner shaft and the exterior of the valve.

26. The valve of claim 25 wherein the outer sleeve is ported adjacent said second spacing member to provide communication for the flow of fluid between the second fluid passage within the outer sleeve and the exterior of the valve.

27. The valve of claim 26 wherein the movement responsive means comprises a hollow outer shaft surrounding the outer sleeve and rotatable relative thereto in sealing relationship, the outer shaft being ported with fluid ports corresponding in longitudinal position to ports of the outer sleeve.

28. A rotary valve comprising:

an inner shaft having a hollow bore portion defining a first fluid passage and a plug blocking the open end of said bore;

a sleeve extending circumferentially about said portion and spaced radially from said shaft to define a second fluid passage;

circumferential spacing means mounted at opposite ends of the second passage; the spacing means, the sleeve and the inner shaft being mounted to rotate as a unit and ported to provide manifolding for the fluid to and from the first passage; the sleeve being further ported to provide manifolding for the fluid to and from the second passage;

an outer shaft having a hollow bore encompassing the sleeve in sealing relationship therewith, the outer shaft being ported in correspondence with the ports of the sleeve and rotatable relative to the sleeve to control the flow of fluid through said ports; and a housing encompassing said shafts and sleeve and having circumferential passages respectively adjacent ports to the first and second fluid passages for coupling the valve to a source of pressurized fluid.

29. A combination rotary valve and actuator including the rotary valve of claim 28 and further comprising:

means for rotating the inner shaft and sleeve to a control position; and a motive member coupled to be responsive to pressurized fluid directed thereto by said valve, the motive member being coupled to the outer shaft to move therewith so as to cause the motive member to assume an angular position corresponding to the control position.

30. The combination of claim 29 wherein the motive member comprises a vaned rotor mounted within a cylindrical housing and an output shaft coupled to the rotor.

* * * * *